US007628023B2

(12) United States Patent
Lucas

(10) Patent No.: US 7,628,023 B2
(45) Date of Patent: Dec. 8, 2009

(54) APPARATUS AND METHOD FOR COOLING A DISPENSED BEVERAGE

(75) Inventor: Philip John Lucas, Golden, CO (US)

(73) Assignee: Millercoors LLC, Golden, CO (US)

( * ) Notice: Subject to any disclaimer, the term of this patent is extended or adjusted under 35 U.S.C. 154(b) by 582 days.

(21) Appl. No.: 11/335,061

(22) Filed: Jan. 18, 2006

(65) Prior Publication Data

US 2007/0163288 A1 Jul. 19, 2007

(51) Int. Cl.
*B67D 5/62* (2006.01)

(52) U.S. Cl. ..... 62/98; 62/389; 165/63; 222/146.6

(58) Field of Classification Search ..... 62/342, 62/98, 389–400; 165/61–66; 222/146.6
See application file for complete search history.

(56) References Cited

U.S. PATENT DOCUMENTS 3,797,268 A * 3/1974 Garavelli ..... 62/258
3,858,498 A * 1/1975 Swenson ..... 99/470
3,898,858 A * 8/1975 Erickson ..... 62/135
5,016,446 A * 5/1991 Fiedler ..... 62/342
5,079,927 A 1/1992 Rodino et al.
5,158,506 A * 10/1992 Kusano et al. ..... 62/136
5,201,861 A * 4/1993 Menzel ..... 62/135
6,101,834 A * 8/2000 Ross ..... 62/342
6,648,025 B2 11/2003 Smith et al.
6,668,576 B1 * 12/2003 Etlender ..... 62/330
2003/0070446 A1 4/2003 Scullion et al.
2003/0161925 A1 8/2003 Scullion et al.
2003/0161932 A1 8/2003 Anderson et al.
2003/0161933 A1 8/2003 Anderson et al.
2003/0211219 A1 11/2003 Scullion et al.
2004/0129004 A1 7/2004 Anderson et al.
2004/0129016 A1 7/2004 Anderson et al.
2004/0129341 A1 7/2004 Anderson et al.
2004/0129342 A1 7/2004 Anderson et al.

* cited by examiner

*Primary Examiner*—William E Tapolcai
(74) *Attorney, Agent, or Firm*—Sheridan Ross PC

(57) ABSTRACT

An apparatus and method are provided for cooling a dispensed beverage. Direct cooling of the beverage is achieved by circulation of a refrigerant in contact with a reservoir that holds the beverage just prior to being dispensed. The reservoir is disposed within a dispense font. The open space within the font acts as an evaporator of a closed refrigeration loop thereby achieving cooling without having to use a separate heat transfer loop. A refrigeration subsystem is mounted directly adjacent the dispense font to provide a controlled flow of refrigerant to the open space within the font. Evaporated refrigerant is recycled in the refrigeration subsystem.

15 Claims, 1 Drawing Sheet

APPARATUS AND METHOD FOR COOLING A DISPENSED BEVERAGE

FIELD OF THE INVENTION

Figures 1, 2:
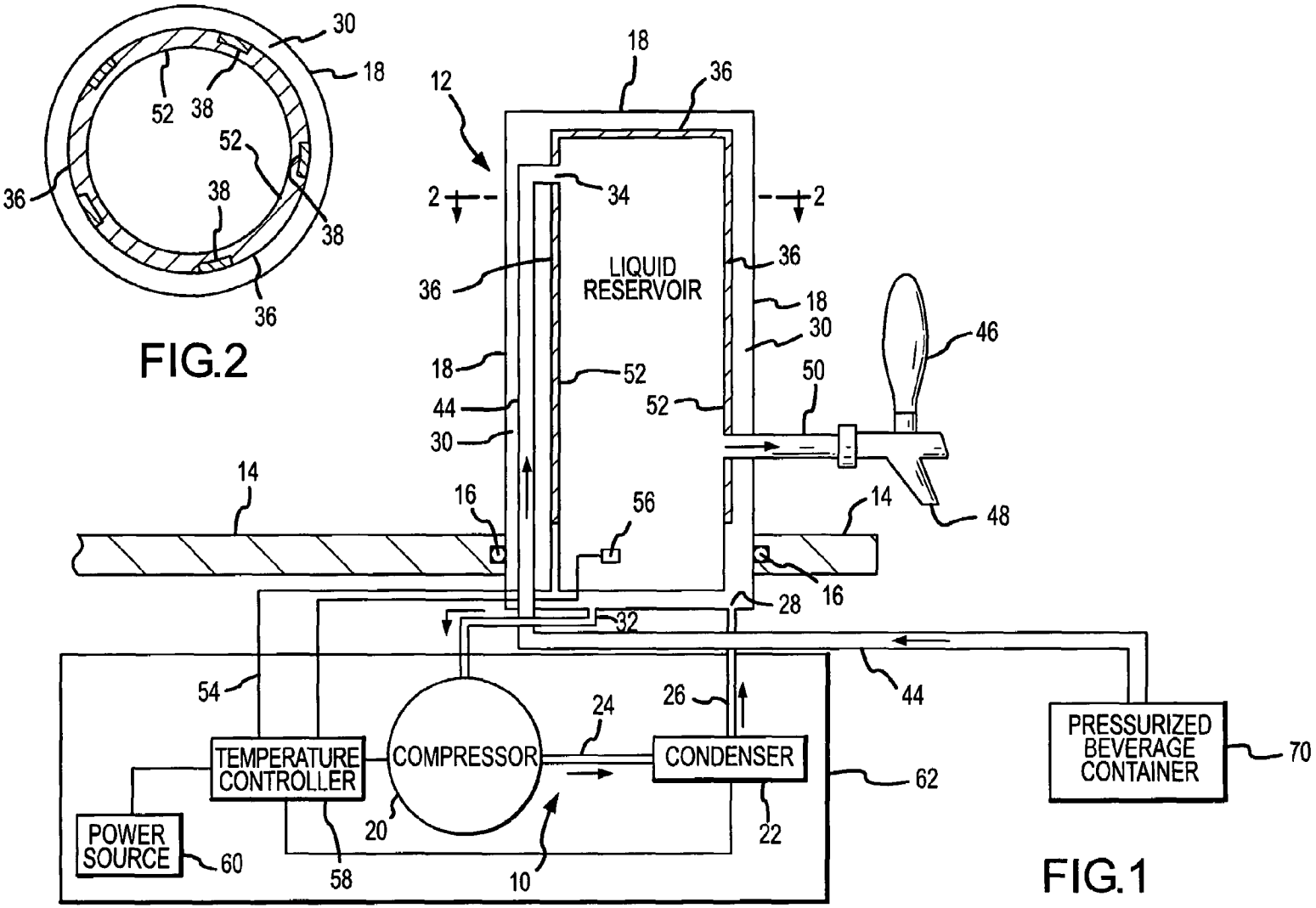

The present invention relates to an apparatus and method for cooling a dispensed beverage, and more particularly, cooling of the beverage by direct contact of a refrigerant with a liquid reservoir that holds the beverage prior to being dispensed.

BACKGROUND OF THE INVENTION

Some beverages, such as beer, are preferably served in a chilled state. For beer on tap dispensed from a dispense tower, it is desirable to cool the beer near the dispense point so that the customer receives the beer at a desired chilled temperature. If the beer is chilled at a location far from the dispense point, the beer will warm due to contact of the beer with the transport line.

There are a number of prior art systems that disclose various ways to chill a dispensed beverage. A few examples of these systems include the inventions disclosed in U.S. Pat. No. 5,079,927; US Patent Publication Nos. US2003/0161925, US2003/0211219, and US2003/0161933.

One common method to chill beer is by the use of a glycol cooling system. In this type of system, a cooled glycol circulation loop is placed in heat transfer relationship with a transport line carrying the beer or a reservoir of the beer. Heat is transferred from the warmer beer to the cooler glycol loop. The warmed glycol is then cooled by circulating the glycol through a heat exchanger which is part of a separate refrigerant loop. The refrigerant loop typically uses a standard refrigerant such as Freon that is continuously recycled in the refrigerant loop. Heat is transferred within the heat exchanger from the warmed glycol to the cooler refrigerant.

For these glycol cooling systems, the cooling of the beer is therefore achieved by indirect cooling. That is, the glycol is the medium which interacts with the warmer beverage to cool the beverage, while the glycol is cooled by a refrigerant. While glycol systems have proven to be adequate for their intended purpose, the requirement to use the glycol circulation loop in conjunction with a refrigerant loop adds to the inefficiency, complexity and cost of a system for cooling a beverage.

Therefore, there is a need for a system and apparatus wherein a dispensed beverage can be effectively and selectively cooled, yet cooling is preferably achieved through a simplified direct cooling system that may be mounted near the point where the beverage is dispensed.

SUMMARY OF THE INVENTION

In accordance with the present invention, an apparatus and method are provided for cooling a dispensed beverage. The need for a simple yet effective cooling system is satisfied with the present invention wherein direct cooling of a beverage is achieved by circulation of a refrigerant in contact with a reservoir that holds the beverage just prior to being dispensed. A dispense font or tower surrounds the reservoir that contains the beverage. The open space within the font acts as the evaporator of a closed refrigeration loop so that direct cooling is achieved without having to use a separate heat transfer loop such as a glycol loop.

In the preferred embodiment, the invention includes a beverage supply group or assembly and a refrigerant group or subsystem. Beginning with the beverage supply assembly, a dispense font is mounted to a bar surface in the traditional manner so that the font is displayed for viewing by a consumer. The dispense font is a sealed chamber that communicates with refrigerant flow lines from the refrigerant group. A liquid reservoir is disposed within the chamber and holds a quantity of the beverage. A supply line passes through the chamber and interconnects the liquid reservoir to a source of the beer such as a keg. A dispense line also passes through the chamber and interconnects the liquid reservoir to a spigot. A tap valve at the spigot controls flow of beverage through the spigot.

The refrigerant group components include a compressor for taking an expanded, evaporated refrigerant, and compressing the same for delivery to a condenser. The condenser acts as a heat exchanger to remove heat from the compressed gas thereby condensing the refrigerant into liquid form. The refrigerant is then circulated into the open space or chamber of the dispense font, and as the refrigerant reaches the expanded internal volume, the refrigerant evaporates thus cooling the beverage contained within the liquid reservoir. The evaporated refrigerant is then drawn back into the compressor for recycling within the refrigeration loop.

The components of the refrigerant group are mounted preferably directly under the bar surface thereby minimizing the length of refrigerant lines which must be used to deliver the refrigerant to the chamber of the dispense font. The refrigerant group can be made of such a compact size that it does not require storage at a separate location. The larger glycol cooling systems are not usually stored at the bar because of space constraints at the bar. The short distances that the refrigerant travels within the refrigeration loop of the present invention minimizes loss of cooling and thus enhances refrigeration capability.

Because of the highly efficient nature of direct cooling achieved by contact of the refrigerant with the liquid reservoir, it may be necessary to periodically heat the beverage to keep it from freezing. Accordingly, a heating jacket can be placed within the dispense font and adjacent the reservoir to selectively heat the reservoir. The heating jacket contains one or more heating elements that are placed in close proximity to the liquid reservoir. The heating elements are selectively energized to provide heat when necessary to prevent the beverage from freezing. Temperature control of the beverage can be achieved by use of a temperature sensor placed within or on the liquid reservoir. The temperature sensor electrically connects to a temperature controller which takes temperature data from the sensor, and periodically activates the heating elements to prevent freezing of the beverage. This temperature data can also be used to control the refrigerant loop by periodically activating the compressor and condenser to provide a flow of refrigerant through the open space of the font.

In accordance with another aspect of the present invention, the direct cooling achieved by the refrigerant which evaporates within the dispense font also cools the outer surface of the dispense font to a degree that frost or ice will develop on the outer surface of the dispense font. The iced surface of the dispense font adds commercial value to the dispense font because it conveys the impression that the beverage to be dispensed has been cooled to a very cold temperature, which is desirable for many customers.

In accordance with yet another aspect of the invention, it may be desirable to allow at least some portion of the beverage to freeze in the liquid reservoir so that when the beverage is dispensed, some amount of the beverage is served frozen.

Other features and advantages of the present invention will become apparent from the drawings, taken in conjunction with the detailed description.

BRIEF DESCRIPTION OF THE INVENTION

FIG. 1 is a schematic view of the apparatus of the present invention, the dispense font and components therein being illustrated in cross section; and FIG. 2 is a horizontal section taken along line 2-2 of FIG. 1 illustrating interior details of the dispense font.

DETAILED DESCRIPTION OF THE DRAWINGS

The apparatus of the present invention is illustrated in FIG. 1. The apparatus may be referred to as a cooling system including a refrigerant group or subsystem and a beverage supply assembly. The beverage supply assembly includes a dispense font 12 preferably mounted to a surface 14, such as a bar surface where the beverage is to be dispensed. The dispense font 12 defines a chamber or housing that extends through an opening in the surface of the bar, and mounting brackets, nuts, or other hardware 16 hold the dispense font 12 in a fixed relationship with the bar surface.

The font body 18 may be made of a desired metal, such as stainless steel. The interior of the font body 18 defines the chamber having an interior open space 30 which acts as the evaporator. Mounted within the open space is a liquid reservoir 52. A supply or inflow line 44 passes through the front body 18 of the dispense font, and connects with the liquid reservoir 52. The opposite end of supply line 44 connects to a beverage source 70, such as a beer keg that is typically pressurized. An outlet or dispense line 50 exits the upper portion of the liquid reservoir, and passes through the body 18 of the dispense font. The locations where the supply line 44 and dispense line 50 pass through the font body are sealed with respect to the font body. The beverage to be dispensed is held within the liquid reservoir, and when the tap handle 46 is operated, the beverage flows through spigot 48.

The refrigeration subsystem of the present invention may be mounted under the bar surface, and directly adjacent the dispense font 12. As shown, the refrigeration subsystem includes a compressor 20 and a condenser 22. The refrigeration subsystem is a closed loop system which circulates a refrigerant. Beginning with the compressor, the refrigerant is compressed into a high pressure gas. The high pressure refrigerant gas flows through line 24 into the condenser 22. The condenser acts as a heat exchanger to remove heat from the high pressure gas thereby changing the gasified refrigerant to a liquid phase. The liquid refrigerant then flows through line 26 into the interior open space 30 of the font. The open space 30 within the font acts as the evaporator of the refrigeration subsystem. As the refrigerant passes into the larger volume of the open space in the dispense font, the liquid refrigerant evaporates thereby removing heat from the open space, the liquid reservoir 52, and the beverage within the reservoir. The refrigerant flows back to the compressor 20 through line 32. Depending upon the amount of cooling necessary, the compressor will continuously or periodically operate to draw in evaporated refrigerant through line 32. The cycle is then repeated by compressing the refrigerant, and passing the refrigerant to the condenser. An orifice 28 defines the interface between line 26 and the interior open space 30. Similarly, orifice 34 defines the interface between the interior open space 30 and the return line 32. Suitable refrigerants for use in the refrigeration subsystem include R134A and R404A. Other refrigerants may also be used depending upon the specific subsystem design and use.

FIG. 1 also illustrates a temperature sensor 56 that may be placed within the liquid reservoir. The temperature sensor electrically connects to a temperature controller 58. The temperature controller 58 controls the activation of the compressor 20 to ensure that the beverage is adequately cooled based on temperature inputs from the temperature sensor 56.

Because of the cooling efficiency of the refrigeration subsystem, it may be necessary to actually add heat to the interior space 30 in order that the beverage does not freeze in lines 44 and 50, as well as in the reservoir 52. Accordingly, a heating jacket 36 may be disposed within the open space 30, and positioned around the liquid reservoir 52. The heating jacket 36 acts as a means to uniformly transfer heat to the liquid reservoir. It is preferable to space the heating elements along the jacket to best distribute the heat to the reservoir. At various locations on the interior surface of the heating jacket 36, as shown in FIG. 2, a plurality of heating elements 38 are provided. The heating elements are electrically connected to the temperature controller 58. The temperature controller also controls operation of the heating elements 38 to selectively activate the same if the temperature sensor 56 indicates that the beverage is below the threshold cooling temperature. The heating elements 38 may be in the form of electrical strip heaters that are wired in series or in parallel, and are directly connected to the controller 58 through electrical line 54. A source of power 60 powers the temperature controller, compressor, condenser, and heating elements. The heating jacket 36 is illustrated as covering the upper surface of the liquid reservoir, as well as a side surface of the liquid reservoir.

Conveniently, the components of the refrigeration subsystem may be mounted directly under the bar surface within a housing 62 which is secured to the lower surface of the bar 14. Thus, no separate storage facility is required for the refrigeration subsystem, and line losses are substantially eliminated by the short distances required for delivering the refrigerant to the open space within the dispense font.

In another aspect of the present invention, the circulation of the refrigerant within the open space of the dispense font many sufficiently cool the dispense font body 18 so that frost and/or ice will form on the outer surface of the dispense font. The formation of frost and ice crystals on the dispense font adds commercial value to the dispense font, particularly for those patrons who enjoy a cooled beverage.

In another aspect of the invention, it may be desirable to provide some portion of the beverage in frozen form. The temperature controller allows precise control so that some of the beverage within the liquid reservoir may freeze.

There are numerous advantages of the present invention in cooling a dispensed beverage. The refrigeration subsystem can be placed very near the reservoir that holds the beverage just prior to being dispensed. Direct cooling is achieved by circulating the refrigerant within the open space of the dispense font. This direct cooling thereby eliminates the need for a separate glycol loop, or other type of secondary cooling loop. The relatively small amount of air space surrounding the liquid reservoir that must be cooled allows the use of very small refrigeration components. These small refrigeration components may be incorporated within a housing that is easily secured under the surface to which the dispense font is mounted. Excess cooling produced by the refrigeration subsystem can be counteracted by a heat source that is also directly incorporated within the dispense font assembly. Use of a temperature controller allows precise control of both the refrigeration subsystem and the heat source.

The apparatus and method of the present invention have been set forth above with respect to a preferred embodiment; however, other changes and modifications to the present invention are contemplated in accordance with the scope of the claims appended hereto.

What is claimed is:

1. An apparatus for cooling a liquid beverage to be dispensed, said apparatus comprising:

a reservoir containing a quantity of the liquid beverage to be dispensed;

a supply line communicating with said reservoir for supplying a flow of the liquid beverage to the reservoir;

a dispense line communicating with said reservoir for dispensing the liquid beverage;

a spigot attached to said dispense line;

a tap handle communicating with said dispense line and said spigot for controlling the dispensing of the liquid beverage;

a dispense font enclosing said liquid reservoir, said dispense font having an interior open space between said reservoir and an interior surface of the dispense font;

refrigeration means for cooling the beverage in the liquid reservoir, said refrigeration means including a compressor for compressing a refrigerant to a high pressure gas, a condenser connected to said compressor for condensing the refrigerant, and said condenser communicating with the open space within said font, said open space causing said refrigerant to evaporate thereby cooling the liquid beverage within the liquid reservoir, and said refrigerant then flowing from said open space within said font back to said compressor; and a heating jacket surrounding said reservoir and disposed within said font in contact with the refrigerant, and heating elements incorporated on said heating jacket for selectively heating the liquid beverage within said liquid reservoir and to prevent the liquid beverage from freezing.

2. An apparatus, as claimed in claim 1, further including:

a temperature sensor disposed within said font and communicating with said beverage in said liquid reservoir, and a temperature controller connected to said temperature sensor and said heating elements, wherein said temperature sensor senses a temperature of the liquid beverage within said reservoir, and said temperature controller activates said heating elements to selectively control the temperature of the liquid beverage.

3. An apparatus, as claimed in claim 1, wherein:

said font is mounted on a surface, said font having a portion extending above said surface and a portion extending below said surface, and said refrigeration means being disposed below said surface and adjacent to said font.

4. An apparatus, as claimed in claim 1, wherein: said heating jacket surrounds said reservoir in a concentric arrangement, and said refrigerant freely flows within the open space of said font, said open space directly communicating with said reservoir and said heating jacket.

5. An apparatus, as claimed in claim 1, wherein:

said heating elements are mounted to and spaced along said heating jacket for substantially even distribution of heat produced from said heating elements to effectively warm the liquid beverage in said liquid reservoir to prevent freezing of the liquid beverage.

6. An apparatus, as claimed in claim 2, wherein:

said temperature sensor is mounted within said liquid reservoir.

7. An apparatus, as claimed in claim 1, wherein:

said refrigerant comprises R134A and R404A.

8. An apparatus, as claimed in claim 1, wherein:

said refrigerant, when flowing from said compressor is a compressed heated gas, and when said refrigerant flows from said condenser, said refrigerant is condensed to a liquid phase.

9. An apparatus, as claimed in claim 1, further including:

a temperature sensor disposed within said font and communicating with said beverage in said reservoir, and a temperature controller connected to said temperature sensor, wherein said temperature sensor senses a temperature of the liquid beverage within said liquid reservoir, and said temperature controller activates said refrigeration means to selectively control cooling provided by said refrigeration means to the open space within said dispense font.

10. An apparatus for cooling a liquid beverage to be dispensed, said apparatus comprising:

a reservoir;

a supply line connected to said liquid reservoir to supply the liquid beverage to said reservoir;

a dispense line connected to said reservoir for dispensing the liquid beverage;

a dispense font mounted over said reservoir and sealing said reservoir therein;

means for delivering refrigeration to an open space within said font and surrounding said reservoir, said means for delivering refrigeration including a refrigerant that is delivered to said open space as a liquid, wherein said refrigerant evaporates forming a low pressure gas and thereby cooling said reservoir, said refrigerant being evacuated from said open space for reuse after evaporation;

a heating jacket disposed within said font surrounding said reservoir and in contact with the refrigerant; and at least one heating element mounted to said heating jacket, wherein said heating element is selectively activated to transfer heat from said heating element to said reservoir for maintaining the liquid beverage within said reservoir at a desired temperature and to prevent the liquid beverage from freezing.

11. An apparatus, as claimed in claim 10, further including:

a compressor communicating with said open space for compressing the refrigerant from the low-pressure gas to a high-pressure gas; and a condenser placed in communication with said compressor, said condenser condensing said high-pressure refrigerant gas to a liquid phase.

12. An apparatus, as claimed in claim 10, further including:

a temperature sensor communicating with said reservoir, and a temperature controller connected to said temperature sensor and said at least one heating element wherein said temperature sensor measures a temperature of the liquid beverage within said reservoir, and said temperature controller selectively activates said at least one heating element to maintain said liquid beverage at the desired temperature within said reservoir.

13. An apparatus, as claimed in claim 10, further including:

a temperature sensor disposed within said font and communicating with said liquid beverage in said reservoir, and a temperature controller connected to said temperature sensor, wherein said temperature sensor senses a temperature of the liquid beverage within said reservoir, and said temperature controller activates said means for delivering refrigeration to selectively control the temperature of the liquid beverage.

14. A method of cooling a dispensed liquid beverage, said method comprising:

providing a font and a closed refrigeration subsystem, said closed refrigeration subsystem including a compressor, a condenser, and an evaporator, said evaporator defined by an open space within said font;

providing a reservoir disposed within said font and surrounded by said open space of said font;

commencing a refrigeration cycle wherein a refrigerant passes from the compressor as a compressed gas, said refrigerant flowing to said condenser and said condenser condensing said refrigerant to a liquid, said refrigerant flowing through said open space within said font and evaporating within said open space;

providing a flow of a liquid beverage through said reservoir;

wherein evaporation of said refrigerant within said open space cools the beverage by heat transfer from the liquid beverage to the open space; and means for heating is placed within said font and adjacent said reservoir in contact with the refrigerant, said means for heating being selectively activated to heat the liquid beverage when the liquid beverage falls below a predetermined temperature to maintain the beverage in a liquid state and thus preventing the liquid from freezing.

15. A method, as claimed in claim 14, wherein:

a temperature sensor is mounted in communication with said reservoir, and a temperature controller electrically connects to said temperature sensor and said heating means, said temperature controller selectively activating said heating means based upon temperature inputs from said temperature sensor.

* * * * *